US007926620B2

(12) United States Patent
Amano

(10) Patent No.: US 7,926,620 B2
(45) Date of Patent: Apr. 19, 2011

(54) ELEVATOR CONTROL APPARATUS AND CONTROL METHOD

(75) Inventor: Masaaki Amano, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 558 days.

(21) Appl. No.: 12/090,303

(22) PCT Filed: Aug. 29, 2006

(86) PCT No.: PCT/JP2006/316932

§ 371 (c)(1),
(2), (4) Date: Apr. 15, 2008

(87) PCT Pub. No.: WO2008/026246

PCT Pub. Date: Mar. 6, 2008

(65) Prior Publication Data

US 2009/0133963 A1 May 28, 2009

(51) Int. Cl.
*B66B 5/02* (2006.01)

(52) U.S. Cl. ..... 187/278; 187/384; 187/387; 187/388; 187/393

(58) Field of Classification Search ..... 187/247, 187/278, 380–389, 391–393, 396, 313
See application file for complete search history.

(56) References Cited

U.S. PATENT DOCUMENTS

| | | | | |
|---|---|---|---|---|
| 4,653,611 | A * | 3/1987 | Ohta et al. | 187/278 |
| 4,690,251 | A * | 9/1987 | Onoda et al. | 187/278 |
| 4,809,817 | A * | 3/1989 | Kawai | 187/278 |
| 7,182,174 | B2 * | 2/2007 | Parrini et al. | 182/18 |
| 7,681,696 | B2 * | 3/2010 | Yamagishi | 187/384 |
| 2010/0213013 | A1 * | 8/2010 | Urata | 187/278 |

FOREIGN PATENT DOCUMENTS

| | | |
|---|---|---|
| JP | 60 204588 | 10/1985 |
| JP | 5 319720 | 12/1993 |
| JP | 2003 146552 | 5/2003 |
| JP | 2004 224469 | 8/2004 |
| JP | 2004 284758 | 10/2004 |
| JP | 2006 206200 | 8/2006 |

* cited by examiner

*Primary Examiner* — Jonathan Salata
(74) *Attorney, Agent, or Firm* — Oblon, Spivak, McClelland, Maier & Neustadt, L.L.P.

(57) ABSTRACT

When a long-period-earthquake occurs, an elevator is controlled to ensure that an abnormality is positively judged and that the elevator can be safely and promptly returned to a normal operation. For this purpose, by providing a usual seismic sensor and a long-period seismic sensor that detects long-period components of the shakes of a building, which are not detected by the usual seismic sensor, at two stages, an earthquake emergency return operation is performed when the seismic sensor has gone into action and when a first level has been detected by the long-period seismic sensor, a long-period-earthquake emergency return operation, which involves giving a notice to outside the elevator and inside a car, is performed. When a second level has been detected by the long-period seismic sensor, a notice is given to outside the elevator and inside a car, and a door opening action is performed by stopping the car at the nearest floor and a long-period-earthquake emergency return operation, which involves causing the car to travel to a temporary-stop floor, is performed, whereby the car is caused to suspend the operation. When no abnormality is discovered by performing an automatic inspection operation under prescribed conditions, the elevator is returned to a normal operation.

4 Claims, 4 Drawing Sheets

ELEVATOR CONTROL APPARATUS AND CONTROL METHOD

TECHNICAL FIELD

The present invention relates to an elevator control apparatus and an elevator control method that are used to perform control operations in response to shakes of a building when the shakes occur in the building due to earthquakes and the like.

BACKGROUND ART

In regions where earthquakes occur frequently as in Japan, elevators have come into widespread use which have the function of performing earthquake emergency return operations in the event of the occurrence of an earthquake in response to the shakes of buildings, i.e., the operating condition of seismic sensors. Incidentally, the above-described seismic sensor is constituted by a two-dimensional accelerometer and the like installed in an elevator machine room and the like, and when shakes of not less than a prescribed value have been sensed by such a seismic sensor as this, for example, a car is stopped at the nearest floor and control is performed thereafter so as to perform a door opening action.

As conventional techniques for an elevator having the function of such an earthquake emergency return operation, there has been proposed, for example, a technique in which a first seismic sensor that detects the shakes of a prescribed high level and a second seismic sensor that detects the shakes of a prescribed low level are provided and an earthquake emergency return operation that responds to the level of shakes is performed when each of the seismic sensors has gone into action. In such an elevator as this, a car is stopped when the first seismic sensor has gone into action. When the second seismic sensor has gone into action, first, the car is stopped at the nearest floor and the inspection of a safety circuit is automatically performed after a lapse of a predetermined time at which the termination of the earthquake is expected. And the elevator is returned to a normal operation under prescribed conditions when no abnormality is discovered in the inspection of the safety circuit (refer to Patent Document 1).

As conventional techniques for an elevator that performs control operations in response to the shakes of a building, there has also been proposed a technique in which an undulatory energy sensor capable of detecting a plurality of strong-wind levels and a controller that controls the elevator on the basis of an output signal from this undulatory energy sensor are provided and a rational control operation that responds to the actual shakes of the building during strong winds is performed. In such an elevator as this, a strong-wind signal indicating that a strong wind has been detected and a plurality of signals indicating the levels of strong winds are output from the undulatory energy sensor to the controller. And the controller that has received each of the signals performs, on the basis of these signals, control operations, such as a deceleration operation, a wait at an intermediate floor and a stop, according to the levels of strong winds (refer to Patent Document 2, for example).

Incidentally, with the tendency toward higher-rise buildings equipped with elevators, recent years have seen reports to the effect that even when shakes against which earthquake emergency return operations are to be performed are not detected by the above-described seismic sensor in the event of the occurrence of a relatively large earthquake in a remote district, long members of an elevator, such as traveling cables and compensating ropes, swing, collide against the equipment in a shaft, and are caught in such equipment. This is because buildings vibrate at a long period due to an earthquake occurring in a remote district, and if the travel of a car is continued in this state, there is a possibility that damage, such as traveling cables and the like being cut and broken equipment in a shaft, occurs.

For this reason, at present, endeavors are being made to develop a new-type seismic sensor that is different from conventional seismic sensors, i.e., a long-period seismic sensor capable of detecting long-period components of the shakes (vibrations) of a building.

There have been trials and proposals to take effective measures against earthquakes before the arrival of a principal motion of the earthquake by distributing an emergency earthquake prompt report to various places immediately after the occurrence of an earthquake by using the Internet and satellite communication on the basis of the information from seismometers (seismic sensors) installed all over Japan. The above-described emergency earthquake prompt report is composed of various kinds of information, such as the occurrence time of the earthquake, the scale of the earthquake, the epicenter, and time allowances until the arrival of a principal motion of the earthquake. The distribution of the above-described emergency earthquake prompt report is based on the technical background that with the recent high-speed, large-capacity designs of general public circuits, high-speed digital circuit networks to realize the Internet and the like have been widely built, permitting high-speed, real-time transmission of information. Incidentally, because the above-described emergency earthquake prompt report is distributed after the occurrence of an earthquake, this report cannot be effectively used in the case of the occurrence of an inland earthquake. However, when a relatively large earthquake has occurred in a remote district, it takes a certain time for a principal motion to arrive after the receipt of an emergency earthquake prompt report. Therefore, if this emergency earthquake prompt report can be effectively used, it is possible to prevent earthquake disasters.

As conventional techniques for an elevator that uses such an emergency earthquake prompt report, there have been proposed techniques that involve receiving an emergency earthquake prompt report, which includes the epicenter of an earthquake and the occurrence time of the earthquake, predicting the arrival time of seismic waves at the present location from the received emergency earthquake prompt report, and controlling earthquake emergency return operations of elevators on the basis of this prediction (refer to Patent Document 3, for example).

Patent Document 1: Japanese Patent Laid-Open No. 60-204588

Patent Document 2: Japanese Patent Laid-Open No. 5-319720

Patent Document 3: Japanese Patent Laid-Open No. 2004-224469

DISCLOSURE OF THE INVENTION

Problems to be Solved by the Invention

In the conventional techniques including those described in Patent Document 1 to Patent Document 3, no concrete constitution has been disclosed as to how an elevator is returned to a normal operation in a case where the occurrence of a long-period earthquake is detected or predicted by the long-period seismic sensor and emergency earthquake prompt report as described above.

No concrete means for coping with a false detection by a long-period seismic sensor and a false emergency earthquake prompt report has been disclosed, either. In the case of the above-described false detection and false report, the problem that the operation efficiency of elevators becomes significantly worse has hitherto occurred.

The present invention has been made to solve problems as described above, and the object of the invention is to provide an elevator control apparatus and an elevator control method that can safely and promptly return an elevator to a normal operation by positively judging an abnormality in the case of the occurrence of a long-period earthquake.

Another object of the invention is to provide an elevator control apparatus and an elevator control method that can cope with the false detection of a long-period seismic sensor and false emergency earthquake prompt reports and prevent the worsening of the operation efficiency.

Means for Solving the Problems

An elevator control apparatus of the present invention is an elevator control apparatus which performs control operations in response to shakes of a building provided with an elevator, comprising a seismic sensor that is provided in the building and detects the shakes of the building at a plurality of levels, a long-period seismic sensor that is provided in the building and detects long-period components of the shakes of the building not detected by the seismic sensor at a prescribed first level and a second level higher than the first level, operation control means that performs an earthquake emergency return operation when the shakes of the building have been detected by the seismic sensor, long-period-earthquake first-level control operation means that gives a notice to outside the elevator and inside a car when a first-level long-period component has been detected by the long-period seismic sensor, long-period-earthquake second-level control operation means that gives a notice to outside the elevator and inside the car when a second-level long-period component has been detected by the long-period seismic sensor, performs a door opening action by stopping the car at the nearest floor, and causes the car to travel to a temporary-stop floor after a lapse of a prescribed time, thereby causing the car to suspend the operation, and operation mode restoration means which causes a normal operation to be restored when, in a case where a second-level long-period component is not detected within a prescribed time after the detection of a first-level long-period component by the long-period seismic sensor, a prescribed time has elapsed after the first-level long-period component is not detected any more, and which causes an normal operation to be restored when, in a case where a second-level long-period component is detected within a prescribed time after the detection of a first-level long-period component by the long-period seismic sensor, no abnormality is discovered in an automatic inspection operation performed thereafter.

Also, an elevator control apparatus of the present invention further comprises a receiving device that receives from outside, in the event of the occurrence of an earthquake, an emergency earthquake prompt report on the earthquake that has occurred, and the long-period-earthquake first-level control operation means and the long-period-earthquake second-level control operation means perform a long-period-earthquake emergency return operation when an emergency earthquake prompt report has been received by the receiving device and a prescribed long-period component of the shakes of the building has been detected by the long-period seismic sensor.

An elevator control method of the present invention is an elevator control method that performs control operations in response to shakes of a building provided with an elevator, comprising, a step of performing an earthquake emergency return operation when the shakes of the building have been detected by the seismic sensor, a step of giving a notice to outside the elevator and inside a car when a prescribed first-level long-period component has been detected by a long-period seismic sensor which detects long-period component of the shakes of the building not detected by the seismic sensor, a step of giving a notice to outside the elevator and inside a car when a long-period component of second-level higher than the first level has been detected by the long-period seismic sensor, performing a door opening action by stopping the car at the nearest floor, and causing the car to travel to a temporary-stop floor after a lapse of a prescribed time, thereby causing the car to suspend the operation, a step of causing a normal operation to be restored when, in a case where a second-level long-period component is not detected within a prescribed time after the detection of a first-level long-period component by the long-period seismic sensor, a prescribed time has elapsed after the first-level long-period component is not detected any more, and a step of causing an normal operation to be restored when, in a case where a second-level long-period component is detected within a prescribed time after the detection of a first-level long-period component by the long-period seismic sensor, no abnormality is discovered in an automatic inspection operation performed thereafter.

Also, an elevator control method of the present invention further comprises a step of receiving from outside, in the event of the occurrence of an earthquake, an emergency earthquake prompt report on the earthquake that has occurred, and a long-period-earthquake emergency return operation is performed when an emergency earthquake prompt report has been received by the receiving device and a prescribed long-period component of the shakes of the building has been detected by the long-period seismic sensor.

Effect of the Invention

According to the present invention, in the case of the occurrence of a long-period earthquake, it is possible to safely and promptly return an elevator to a normal operation by positively judging an abnormality.

Also, according to the present invention, it is possible to cope with a false detection by a long-period seismic sensor and a false emergency earthquake prompt report and to prevent the worsening of the operation efficiency.

DESCRIPTION OF SYMBOLS

1 controller,

1*a* information input/output means,

1*b* operation control means,

1*c* long-period-earthquake first-level control operation means,

1*d* long-period-earthquake second-level control operation means,

1*e* operation-mode restoration means,

2 seismic sensor,

3 long-period seismic sensor,

4 warning panel,

4*a* first level lamp,

4*b* second level lamp,

5 car,

5*a* announce device,

5*b* indication device,

6 emergency earthquake prompt report receiving device

BEST MODE FOR CARRYING OUT THE INVENTION

The present invention will be described in more detail with reference to the accompanying drawings. Incidentally, in each of the drawings, same numerals refer to same or like parts and overlaps of descriptions of these parts are appropriately simplified or omitted.

Embodiment 1

Figure 1:
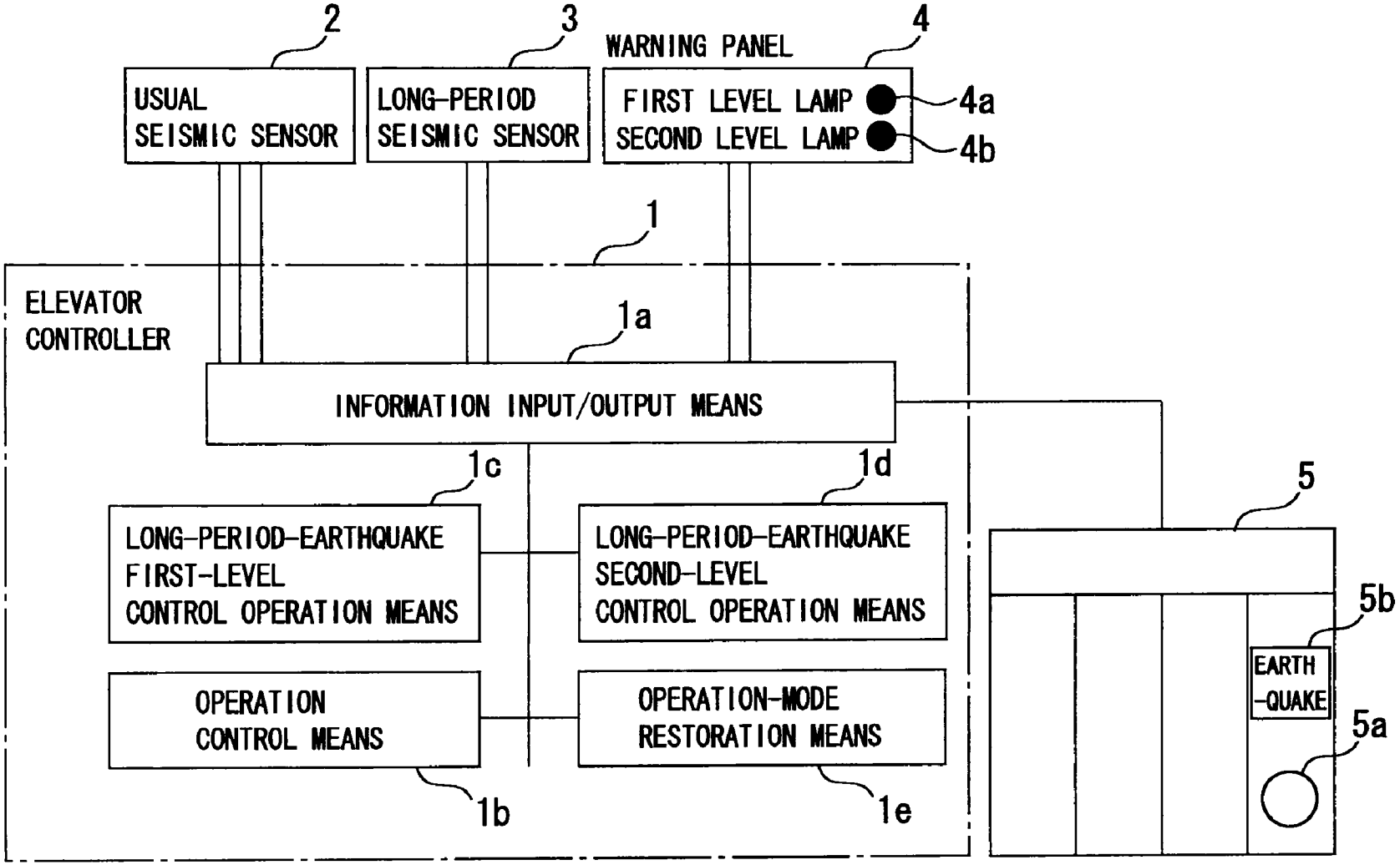
FIG. 1 is a block diagram showing an elevator controller in Embodiment 1 of the present invention.
Figure 2:
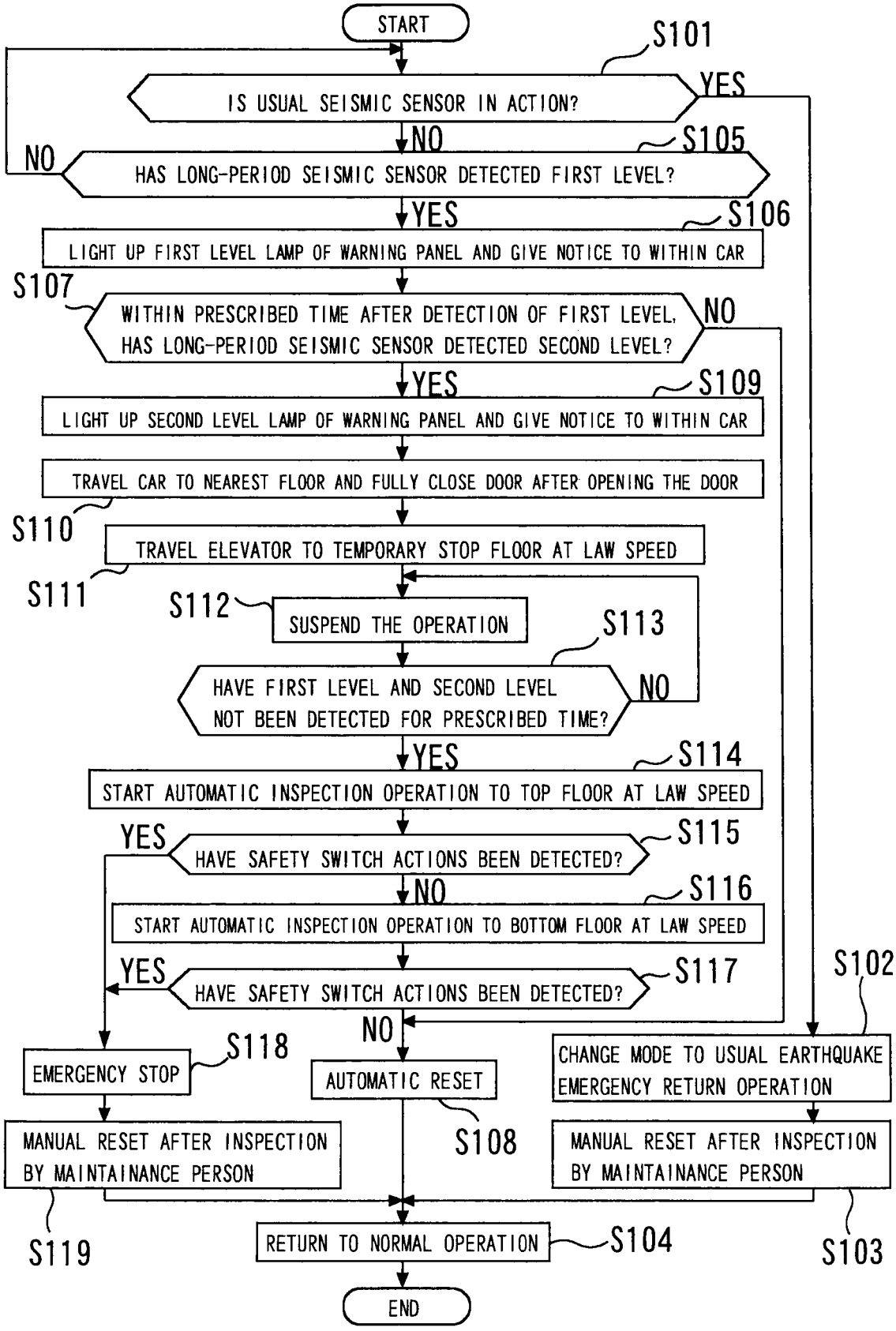
FIG. 2 is a flowchart showing the actions of the elevator controller in Embodiment 1 of the present invention.

FIG. 1 is a block diagram showing an elevator controller in Embodiment 1 of the present invention, and FIG. 2 is a flowchart showing the actions of the elevator controller in Embodiment 1 of the present invention. First, the configuration of the elevator controller will be described on the basis of FIG. 1. The reference numeral 1 denotes the controller that conducts various kinds of operation control of an elevator, and the reference numeral 2 denotes a usual seismic sensor that is provided in a building equipped with an elevator and comprises a two-dimensional accelerometer and the like. The seismic sensor 2 is connected to the controller 1 by a communication line and the like, and configured to be able to detect the shakes of the building at a plurality of levels. For example, the seismic sensor 2 detects the shakes (acceleration and the like) of the building at prescribed three levels: primary wave of an earthquake, prescribed low gals and prescribed high gals whose value is higher than the low gals, and outputs, to the controller 1, earthquake detection information corresponding to each of the levels when the seismic sensor 2 has detected the shakes of each level.

The reference numeral 3 denotes a long-period seismic sensor provided in the building equipped with the elevator. This long-period seismic sensor 3 is connected to the controller 1 by a communication line and the like, and configured to be able to detect long-period components of the shakes of the building that are not detected by the above-described seismic sensor 2 at a plurality of levels. For example, the long-period seismic sensor 3 detects long-period components of the shakes of the building at two levels: a prescribed first level and a prescribed second level higher than the first level. And the long-period seismic sensor 3 outputs, to the controller 1, long-period earthquake detection information corresponding to each of the levels when the long-period seismic sensor 3 has detected the long-period components at each of the above-described levels from the shaking of the building.

The reference numeral 4 denotes a warning panel provided outside the elevator, and is installed, for example, in a disaster prevention center, a supervisory center that monitors the elevator and the like. This warning panel 4 is connected to the controller 1 by a communication line and the like. The warning panel 4 is provided with a first level lamp 4*a* that gives a notice to the surrounding to the effect that the long-period seismic sensor 3 has detected a first-level long-period component, and with a second level lamp 4*b* that gives a notice to the surrounding to the effect that the long-period seismic sensor 3 has detected a second-level long-period component. The reference numeral 5 denotes a car that ascends and descends within an elevator shaft. This car 5 is connected to the controller 1 by a communication line and the like, and various kinds of control of the car 5 are performed in accordance with the instructions from the controller 1. In the interior of the car 5, there are provided an announce device 5*a* that informs passengers within the car 5 of various kinds of information by voice and an indication device 5*b* that informs the passengers within the car 5 of various kinds of information by indicating letters, lamps and the like.

As shown in FIG. 1, the above-described controller 1 is provided with information input/output means 1*a*, operation control means 1*b*, long-period-earthquake first-level control operation means 1*c*, long-period-earthquake second-level control operation means 1*d*, and operation-mode restoration means 1*e*. The information input/output means 1*a* is means by which the controller 1 performs communication for various kinds of control with external equipment and the like connected by a communication line and the like and with internal equipment, such as the car 5, that is, the information input/output means 1*a* is means for performing the input/output of information. Concretely, information on earthquake detection information in each district from the seismic sensor 2 and each piece of long-period-earthquake detection information from the long-period seismic sensor 3 are input to the information input/output means 1*a*, and in order to cause the first level lamp 4*a* and the second level lamp 4*b* to light up under prescribed conditions, the information input/output means 1*a* outputs to the warning panel 4 instructions for causing each lamp to light up. In each operation mode, such as a normal operation, an earthquake emergency return operation and a long-period-earthquake emergency return operation, various kinds of information are input and various instructions are output between information input/output means 1*a* and internal equipment, such as the car 5 and a safety device.

The operation control means 1*b* is means for controlling various kinds of operations in a normal operation of the elevator and controlling an earthquake emergency return operation when the shakes of the building are detected by the seismic sensor 2. Incidentally, when earthquake detection information has been input from the seismic sensor 2 to the controller 1 via the information input/output means 1*a*, on the basis of the input earthquake detection information, the operation control means 1*b* performs an earthquake emergency return operation that responds to the levels of the shakes of the building.

The long-period-earthquake first-level control operation means 1*c* is means for controlling a long-period-earthquake emergency return operation that copes with a case where the long-period seismic sensor 3 has detected a first-level long component (hereinafter called "a first-level, long-period-earthquake emergency return operation") when a first-level long-period component has been detected by the long-period seismic sensor 3, that is, when the long-period-earthquake detection information to the effect that a first-level long-period component has been detected (hereinafter called "a first-level, long-period-earthquake detection information") is input from the long-period seismic sensor 3 to the controller 1 via the information input/output means 1*a*. Incidentally, in the above-described first-level, long-period-earthquake emergency return operation, a notice is given to outside the elevator and inside the car 5 in order to arouse attention, and for example, the lighting up of the first level lamp 4*a* of the warning panel 4, audio guidance by the announce device 5*a* within the car 5, and indication guidance by the indication device 5*b* within the car 5 and the like are performed.

The long-period-earthquake second-level control operation means 1*d* is means for controlling a long-period-earthquake emergency return operation that copes with a case where the long-period seismic sensor 3 has detected a second-level long component (hereinafter called "a second-level, long-period-earthquake emergency return operation") when a second-level long-period component has been detected by the long-period seismic sensor 3, that is, when the long-period-earthquake detection information to the effect that a second-level long-period component has been detected (hereinafter called "a second-level, long-period-earthquake detection information") is input from the long-period seismic sensor 3 to the controller 1 via the information input/output means 1*a*. Incidentally, in the above-described second-level, long-period-earthquake emergency return operation, a notice is given to outside the elevator and inside the car 5 in order to give warning, and for example, the lighting up of the second level lamp 4*b* of the warning panel 4, audio guidance by the announce device 5*a* within the car 5, and indication guidance by the indication device 5*b* within the car 5 and the like are performed. Furthermore, in the second-level, long-period-earthquake emergency return operation, in parallel with the above-described giving a notice, the following operations are carried out: a rescue operation, which involves performing a door opening action by stopping the car 5 at the nearest floor, and rescuing the passengers in the car 5, an evacuation operation, which involves performing a door closing action after the rescuing operation, and causing the car to travel to a temporary-stop floor after a lapse of a prescribed time, thereby causing the car to suspend the operation, an automatic inspection operation, which involves checking for abnormalities in the equipment, caught-in main ropes and the like under prescribed conditions after the evacuation operation, and the like.

The operation mode restoration means 1*e* is means for causing a normal operation to be automatically restored under the prescribed conditions that there is no abnormality in each piece of equipment of the elevator after a long-period component of the shakes of the building is detected by the long-period seismic sensor 3 and the operation mode is changed from a normal operation to a long-period-earthquake emergency return operation. Concretely, the above-described operation mode restoration means 1*e* causes a normal operation to be automatically restored by regarding that the shakes of the building have finished when, in a case where a second-level long-period component is not detected within a prescribed time after the detection of a first-level long-period component by the long-period seismic sensor 3, a prescribed time has elapsed after the first-level long-period component is not detected any more. Furthermore, the above-described operation mode restoration means 1*e* causes a normal operation to be automatically restored by regarding that there is no damage by a long-period earthquake when, in a case where a second-level long-period component is detected within a prescribed time after the detection of a first-level long-period component by the long-period seismic sensor 3, no abnormality is discovered in an automatic inspection operation performed thereafter.

Next, the operation of the elevator controller having the above-described configuration will be described on the basis of FIG. 2.

During a normal operation of the elevator, in the controller 1, judgment is constantly passed as to whether an earthquake is occurring (the building is shaking) or not. Concretely, the controller 1 judges whether the usual seismic sensor 2 is in action, that is, whether earthquake detection information has been input from the seismic sensor 2 to the information input/output means 1*a* (Step S101). Incidentally, when an earthquake has occurred in the vicinity of the building equipped with the elevator, the shakes of the building by the earthquake are detected by the usual seismic sensor 2 and earthquake detection information corresponding to the level of the detected shakes is input from the seismic sensor 2 to the information input/output means 1*a*. In the controller 1, due to the input of the earthquake detection information to the information input/output means 1*a*, the operation mode is changed from a normal operation to a usual earthquake emergency return operation (Step S102). An earthquake emergency return operation that responds to the level of the shakes of the building is performed by the operation control means 1*b*. And after the completion of the earthquake emergency return operation, inspection is performed by a maintenance person of the elevator. In such a case as this, the normal condition is ascertained and manual reset is performed by the maintenance person (Step S103), whereby the elevator is returned to a normal operation (Step S104).

Also, in the controller 1, judgment is constantly passed as to whether a long-period earthquake is occurring in addition to whether a usual earthquake is occurring. Concretely, when the seismic sensor 2 is not in action (Step S101), the controller 1 judges whether the long-period seismic sensor 3 has detected a first-level long-period component (Step S105). Incidentally, when a first-level long-period component has not been detected by the long-period seismic sensor 3, the controller 1 continuously judges whether a usual earthquake and a long-period earthquake have occurred (Steps S101, S105).

On the other hand, when a first-level long-period component has been detected by the long-period seismic sensor 3 (Step S105), first-level long-period-earthquake detection information is input from the long-period seismic sensor 3 to the information input/output means 1*a*. In the controller 1, due to the input of the first-level long-period-earthquake detection information to the information input/output means 1*a*, the operation mode is changed from a normal operation to a long-period-earthquake emergency return operation and the long-period-earthquake first-level control operation means 1*c* performs a first-level, long-period-earthquake emergency return operation. Concretely, for the purpose of giving a notice to outside the elevator and inside the car 5 in order to arouse attention, the long-period earthquake first-level control operation means 1*c* outputs to the warning panel 4 instructions for causing the first level lamp 4*a* to light up, whereby the first level lamp 4*a* lights up. At the same time, audio guidance by the announce device 5*a* and indication guidance by the indication device 5*b* are performed (Step S106).

The controller 1 judges whether a second-level long-period component has been detected by the long-period seismic sensor 3 within a prescribed time after the detection of a first-level long-period component by the long-period seismic sensor 3 (Step S107). In a case where a second-level long-period component is not detected by the long-period seismic sensor 3 within the above-described prescribed time (Step S107), it is judged that the shakes of the building have finished when a prescribed time has elapsed after the first-level long-period component is not detected any more, and automatic reset is performed by the operation mode restoration means 1*e* (Step S108) and the elevator is returned to a normal operation (Step S104).

On the other hand, when a second-level long-period component is detected by the long-period seismic sensor 3 (Step S107), second-level long-period-earthquake detection information is input from the long-period seismic sensor 3 to the information input/output means 1*a*. In the controller 1, due to the input of the second-level long-period-earthquake detection information to the information input/output means 1*a*, the long-period-earthquake second-level control operation means 1*d* performs a second-level, long-period-earthquake emergency return operation. Concretely, for the purpose of giving a notice to outside the elevator and inside the car 5 in order to give warning, the long-period-earthquake second-level control means 1*d* outputs to the warning panel 4 instructions for causing the second level lamp 4*b* to light up, whereby the second level lamp 4*b* lights up. At the same time, audio guidance by the announce device 5*a* and indication guidance by the indication device 5*b* are performed (Step S109).

In a second-level, long-period-earthquake emergency return operation, the car 5 is caused to travel to the nearest floor and the passengers in the car 5 are rescued by performing a door opening action after stopping at the nearest floor. Furthermore, in order to prevent persons from getting into the car 5 by mistake, a door closing operation is performed after a lapse of a prescribed time following the start of the door opening operation and a fully closed condition is maintained thereafter (Step S10). After the full closing of the door, the car 5 is caused to travel to a prescribed temporary-stop floor at a low speed (Step S111) and is stopped at the temporary-stop floor, where the car is thereafter kept in a temporary-stop condition (Step S112). The above-described temporary-stop floor is set, for example, at a floor where the elevator long members such as the main ropes do not resonate with the shakes of the building even when the car 5 stops.

After the elevator is brought into the temporary-stop condition, the long-period seismic sensor 3 judges whether both a first-level long-period component and a second-level long-period component have not been detected for a prescribed time (Step S113). When within the above-described prescribed time a first-level long-period component or a second-level long-period component has been detected (Step S113), the temporary-stop condition is further continued (Step S112).

On the other hand, when neither a first-level long-period component nor a second-level long-period component has been detected by the long-period seismic sensor 3 for a prescribed time (Step S113), the car 5 is caused to travel at a low speed and an automatic inspection operation is performed which involves checking for abnormalities in the equipment, caught-in main ropes and the like. Incidentally, in the above-described automatic inspection operation, abnormalities in the elevator are automatically discovered, for example, by monitoring the torque of a traction machine (not shown) and the like while causing the car 5 to reciprocate within the shaft at a low speed. Concretely, the car 5 is caused to travel from the temporary-stop floor to the top floor (Step S114) and judgment is passed as to whether the actions of various kinds of safety switches have been detected during the travel (Step S115). Also, after the car 5 is caused to travel to the top floor, the car 5 is caused to travel further to the bottom floor at a low speed (Step S116) and judgment is passed as to whether the actions of various kinds of safety switches have been detected during the travel (Step S117). When during the automatic inspection operations at Steps S114 and S116 the actions of the safety switches are detected, it is judged that an abnormality in the elevator has been discovered and the car 5 is brought into an emergency stop (Step S118).

Incidentally, in the second-level, long-period-earthquake emergency return operation including the above-described automatic inspection operation, various kinds of control are performed by the long-period earthquake second-level control operation means 1*d*.

And when the car 5 has been brought into an emergency stop in the above-described automatic inspection operation (Step S118), after a normal condition is ascertained by the elevator maintenance person, automatic reset is performed (Step S119) and the elevator is returned to a normal operation (Step S104). When in the above-described automatic inspection operation no abnormality has been discovered, automatic reset is performed by the operation mode restoration means 1*e* (Step S1108) and the elevator is returned to a normal operation (Step S104).

Incidentally, though this is not illustrated in FIG. 2, in a case where the shakes of the building have been detected by the seismic sensor 2 even after the detection of a first-level long-period component by the long-period seismic sensor 3 at Step S105, the operation mode is changed from a long-period-earthquake emergency return operation to a usual earthquake emergency return operation, and an earthquake emergency return operation that responds to the level of the shakes of the building is preferentially performed by the operation control means 1*b*.

According to the first embodiment of the present invention, even when a prescribed long-period component of the shakes of a building is detected by the long-period seismic sensor 3, it is possible to positively judge abnormalities in an elevator and it is possible to safely return the elevator to a normal operation. When no abnormality in the elevator is discovered, it is possible to promptly return the elevator to a normal operation, and it is possible to expect the advantage that the elevator stop time is shortened.

Embodiment 2

Figure 3:
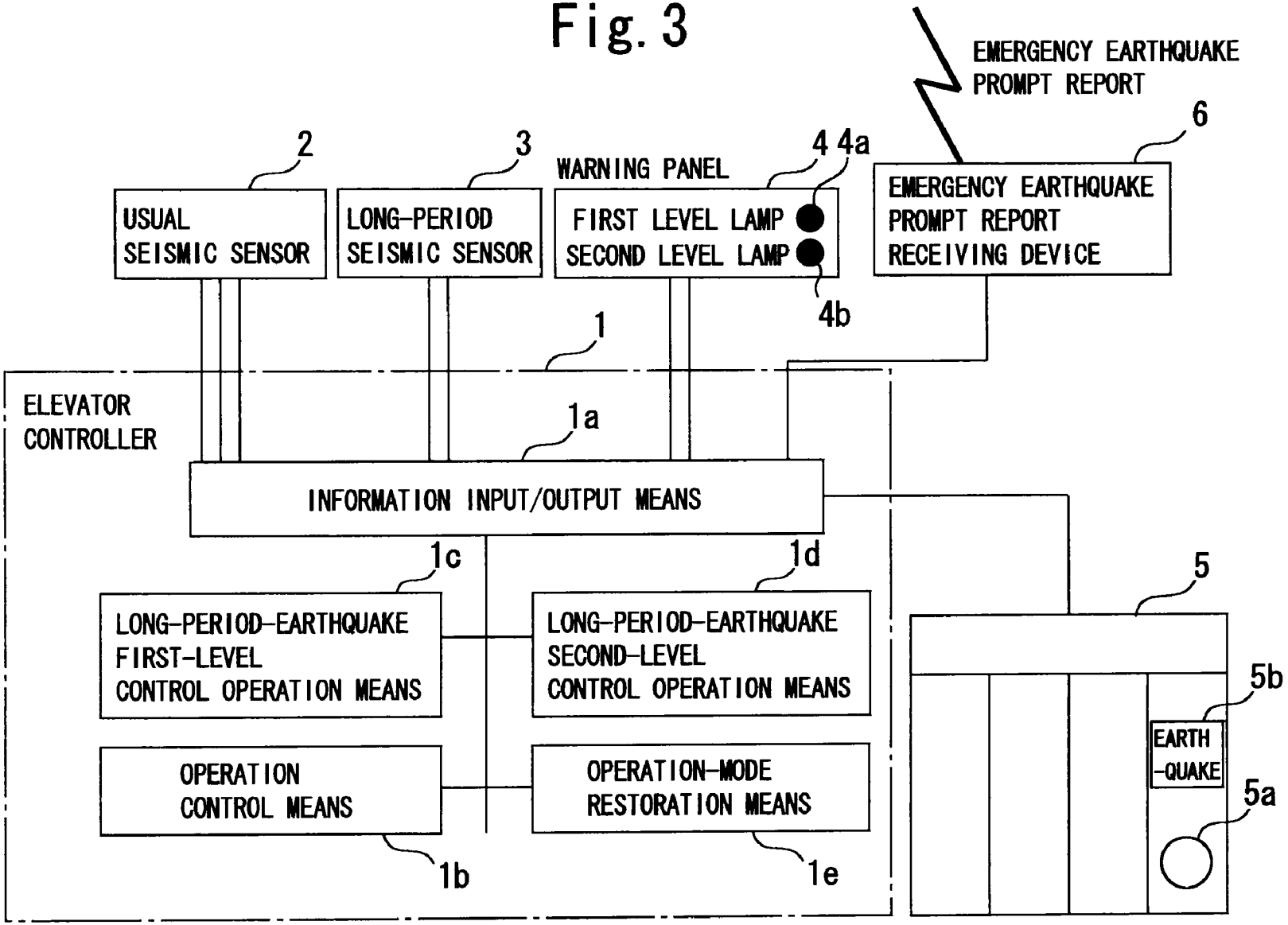
FIG. 3 is a block diagram showing an elevator controller in the second embodiment of the present invention.
Figure 4:
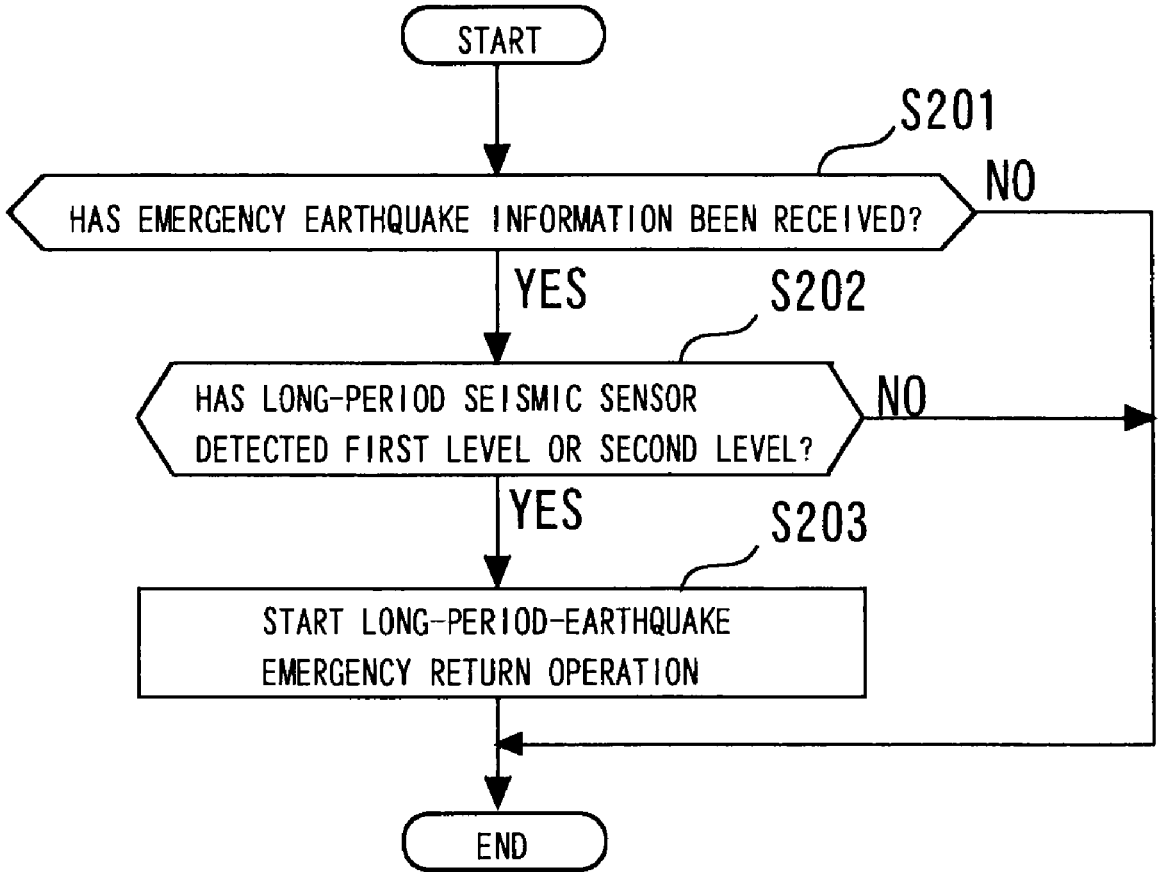
FIG. 4 is a flowchart showing the actions of the elevator controller in Embodiment 2 of the present invention.

FIG. 3 is a block diagram showing an elevator controller in the second embodiment of the present invention, and FIG. 4 is a flowchart showing the actions of the elevator controller in Embodiment 2 of the present invention. First, the configuration of the elevator controller will be described on the basis of FIG. 3. The reference numeral 6 denotes an emergency earthquake prompt report receiving device that is provided in a building equipped with an elevator and receives from outside, in the event of the occurrence of an earthquake, an emergency earthquake prompt report on the earthquake that occurred. Incidentally, the above-described emergency earthquake prompt report is composed of various kinds of information, such as the occurrence time of the earthquake, the scale of the earthquake, the epicenter, and time allowances until the arrival of a principal motion of the earthquake, and this report is distributed by the Japan Meteorological Agency and distributors or the like entrusted by this agency by use of high-speed communication networks, such as the Internet and satellite communication. Incidentally, for high-speed communication networks to distribute an emergency earthquake prompt report, the distribution of an emergency earthquake prompt report is performed by using high-speed digital circuit networks based on a VPN (Virtual Private Network) with a high level of security, which has recently been frequently used in the Internet among enterprises, and an ADSL (Asymmetric Digital Subscriber Line) for general households or circuit networks for broadcasting through satellites and the like.

The above-described emergency earthquake prompt report receiving device 6 is connected to a controller 1 by a communication line and the like, and outputs emergency earthquake information to the controller 1 under prescribed conditions when the emergency earthquake prompt report receiving device 6 has received an emergency earthquake prompt report. That is, upon receipt of an emergency earthquake prompt report, the emergency earthquake prompt report receiving device 6 calculates the degree of the effect on the building equipped with the elevator on the basis of the received emergency earthquake prompt report, and outputs emergency earthquake information to the controller 1 when the emergency earthquake prompt report receiving device 6 has judged that earthquake motions exceeding a certain threshold value will arrive.

The long-period-earthquake first-level control operation means 1*c* and the long-period-earthquake second-level control operation means 1*d* are configured to perform a long-period-earthquake emergency return operation when emergency earthquake information is output from the emergency earthquake prompt report receiving device 6 to the controller 1 and a prescribed long-period component of the shakes of the building has been detected by a long-period seismic sensor 3. Incidentally, other configurational features are the same as in Embodiment 1.

Next, the operation of the elevator controller having the above-described configuration will be described on the basis of FIG. 4.

Incidentally, Step S201 in FIG. 4 is performed when a usual seismic sensor 2 is not in action at Step S101 in FIG. 2. That is, when it is judged by the controller 1 that a usual seismic sensor 2 is not in action, then judgment is passed as to whether emergency earthquake information has been input from the emergency earthquake prompt report receiving device 6 (Step S201). When no emergency earthquake information has been input from the emergency earthquake prompt report receiving device 6, the controller 1 continuously judges whether a usual earthquake and a long-period earthquake have occurred.

On the other hand, when emergency earthquake information has been input from the emergency earthquake prompt report receiving device 6 (Step S201), judgment is passed as to whether a prescribed long-period component of the shakes of the building has been detected by the long-period seismic sensor 3 (Step S202). And when a prescribed long-period component of the shakes of the building has not been detected by the long-period seismic sensor 3, it is regarded that this is a false emergency earthquake prompt report or that an earthquake that actually occurred in a remote district has no effect on the building, and the action is finished, that is, judgment is passed again as to whether a usual earthquake and a long-period earthquake have occurred.

When a prescribed long-period component of the shakes of the building has been detected by the long-period seismic sensor 3 (Step S202), the long-period earthquake emergency return operation described at Step S106 and following steps of FIG. 2 is performed (Step S203). Incidentally, a long-period earthquake emergency return operation is not performed when emergency earthquake information has not been input to the controller 1 even in the case where a prescribed long-period component of the shakes of the building has been detected by the long-period seismic sensor 3.

According to the second embodiment of the present invention, due to the combination of the receipt of an emergency earthquake prompt report by the emergency earthquake prompt report receiving device 6 and the detection of a long-period component of the shakes of the building by the long-period seismic sensor 3, judgment is passed as to whether the building is actually vibrating at a long period. Therefore, it is possible to realize a high-accuracy, long-period-earthquake emergency return operation as a system. That is, even in the case of the occurrence of a false detection by the long-period seismic sensor 3 and of a false emergency earthquake prompt report, it is possible to positively change the operation mode to a long-period-earthquake emergency return operation without worsening the operation efficiency of the elevator in a case where the building is actually vibrating at a long period due to an earthquake that occurred in a remote district.

Incidentally, it is also possible that emergency earthquake information of a plurality of levels is output from the above-described emergency earthquake prompt report receiving device 6 and control that responds to emergency earthquake information of each level may be performed in the controller 1. In this case, for example, the emergency earthquake information output from the emergency earthquake prompt report receiving device 6 is composed of two stages: a prescribed first level and a second level higher than this first level, and the controller 1 performs a first-level, long-period-earthquake emergency return operation when both first-level emergency earthquake information and first-level, long-period-earthquake detection information have been input to the information input/output means 1*a*. And the controller 1 performs a second-level, long-period-earthquake emergency return operation when both second-level emergency earthquake information and second-level, long-period-earthquake detection information have been input to the information input/output means 1*a*.

On the other hand, it is also possible that a prescribed calculation for outputting emergency earthquake information is not performed in the above-described emergency earthquake prompt report receiving device 6 and instead of this in all cases where an emergency earthquake prompt report has been received, emergency earthquake information may be output from the emergency earthquake prompt report receiving device 6 to the controller 1. Although in the second embodiment the description was given of the case where the emergency earthquake prompt report receiving device 6 is installed for each building equipped with elevators, it is also possible that the emergency earthquake prompt report receiving device 6 is installed in a supervisory center that performs the central control of a plurality of elevators at a location remote from the building and the like, and emergency earthquake information may be transmitted by one operation to the plurality of elevators connected by communication lines and the like when the emergency earthquake prompt report receiving device 6 has received emergency prompt report.

INDUSTRIAL APPLICABILITY

As described above, according to the elevator apparatus related to the present invention, even in the case of the occurrence of a long-period earthquake, it is possible to safely and promptly return an elevator to a normal operation by positively judging an abnormality. For this reason, it is possible to provide an elevator having high reliability and safety.

Furthermore, it is possible to cope with a false detection by a long-period seismic sensor and a false emergency earthquake prompt report and it is possible to prevent the worsening of the operation efficiency. At the same time, when a building is actually vibrating due to an earthquake that occurred in a remote district, it is possible to positively change the operation mode to a long-period-earthquake emergency return operation.

The invention claimed is:

1. An elevator control apparatus performing control operations in response to shakes of a building provided with an elevator, characterized in that the elevator control apparatus comprises:

a seismic sensor that is provided in the building and detects the shakes of the building at a plurality of levels, a long-period seismic sensor that is provided in the building and detects long-period components of the shakes of the building not detected by the seismic sensor at a prescribed first level and a second level higher than the first level, operation control means that performs an earthquake emergency return operation when the shakes of the building have been detected by the seismic sensor, long-period-earthquake first-level control operation means that gives a notice to outside the elevator and inside a car when a first-level long-period component has been detected by the long-period seismic sensor, long-period-earthquake second-level control operation means that gives a notice to outside the elevator and inside the car when a second-level long-period component has been detected by the long-period seismic sensor, performs a door opening action by stopping the car at the nearest floor, and causes the car to travel to a temporary-stop floor after a lapse of a prescribed time, thereby causing the car to suspend the operation, and operation mode restoration means which causes a normal operation to be restored when, in a case where a second-level long-period component is not detected within a prescribed time after the detection of a first-level long-period component by the long-period seismic sensor, a prescribed time has elapsed after the first-level long-period component is not detected any more, and which causes an normal operation to be restored when, in a case where a second-level long-period component is detected within a prescribed time after the detection of a first-level long-period component by the long-period seismic sensor, no abnormality is discovered in an automatic inspection operation performed thereafter.

2. The elevator control apparatus according to claim 1, characterized in that the elevator control apparatus further comprises a receiving device that receives from outside, in the event of the occurrence of an earthquake, an emergency earthquake prompt report on the earthquake that has occurred, and in that the long-period-earthquake first-level control operation means and the long-period-earthquake second-level control operation means perform a long-period-earthquake emergency return operation when an emergency earthquake prompt report has been received by the receiving device and a prescribed long-period component of the shakes of the building has been detected by the long-period seismic sensor.

3. An elevator control method for performing control operations in response to shakes of a building provided with an elevator, characterized in that the elevator control method comprises:

a step of performing an earthquake emergency return operation when the shakes of the building have been detected by the seismic sensor, a step of giving a notice to outside the elevator and inside a car when a prescribed first-level long-period component has been detected by a long-period seismic sensor which detects long-period component of the shakes of the building not detected by the seismic sensor, a step of giving a notice to outside the elevator and inside a car when a long-period component of second-level higher than the first level has been detected by the long-period seismic sensor, performing a door opening action by stopping the car at the nearest floor, and causing the car to travel to a temporary-stop floor after a lapse of a prescribed time, thereby causing the car to suspend the operation, a step of causing a normal operation to be restored when, in a case where a second-level long-period component is not detected within a prescribed time after the detection of a first-level long-period component by the long-period seismic sensor, a prescribed time has elapsed after the first-level long-period component is not detected any more, and a step of causing an normal operation to be restored when, in a case where a second-level long-period component is detected within a prescribed time after the detection of a first-level long-period component by the long-period seismic sensor, no abnormality is discovered in an automatic inspection operation performed thereafter.

4. The elevator control method according to claim 3, characterized in that the elevator control method further comprises a step of receiving from outside, in the event of the occurrence of an earthquake, an emergency earthquake prompt report on the earthquake that has occurred, and in that a long-period-earthquake emergency return operation is performed when an emergency earthquake prompt report has been received by the receiving device and a prescribed long-period component of the shakes of the building has been detected by the long-period seismic sensor.

* * * * *